US009156609B2

(12) United States Patent
Chitwood et al.

(10) Patent No.: US 9,156,609 B2
(45) Date of Patent: Oct. 13, 2015

(54) LARGE SUBSEA PACKAGE DEPLOYMENT METHODS AND DEVICES

(71) Applicant: Safe Marine Transfer, LLC, Houston, TX (US)

(72) Inventors: James E. Chitwood, Houston, TX (US); Art J. Schroeder, Jr., Houston, TX (US)

(73) Assignee: Safe Marine Transfer, LLC, Houston, TX (US)

( * ) Notice: Subject to any disclaimer, the term of this patent is extended or adjusted under 35 U.S.C. 154(b) by 0 days.

(21) Appl. No.: 14/203,635

(22) Filed: Mar. 11, 2014

(65) Prior Publication Data

US 2014/0341657 A1 Nov. 20, 2014

Related U.S. Application Data

(63) Continuation-in-part of application No. 13/858,024, filed on Apr. 6, 2013.

(51) Int. Cl.

| | |
|---|---|
| ***B65D 88/78*** | (2006.01) |
| ***B63B 35/44*** | (2006.01) |
| ***B63B 38/00*** | (2006.01) |
| ***B65D 90/50*** | (2006.01) |
| ***B65D 27/08*** | (2006.01) |
| ***B63B 35/28*** | (2006.01) |
| ***B63B 43/06*** | (2006.01) |

(52) U.S. Cl.

CPC ..... *B65D 88/78* (2013.01); *B63B 35/28* (2013.01); *B63B 35/44* (2013.01); *B63B 38/00* (2013.01); *B63B 43/06* (2013.01); *B65D 27/08* (2013.01); *B65D 90/501* (2013.01)

(58) Field of Classification Search

CPC ..... B65D 88/78
USPC ..... 405/210
See application file for complete search history.

(56) References Cited

U.S. PATENT DOCUMENTS

| | | | | |
|---|---|---|---|---|
| 2,924,350 | A * | 2/1960 | Greer | 405/210 |
| 3,471,349 | A | 10/1969 | Cohen et al. | |
| 3,675,427 | A * | 7/1972 | Hix, Jr. | 405/53 |
| 3,727,418 | A * | 4/1973 | Glazier | 405/210 |
| 3,835,653 | A * | 9/1974 | Hix, Jr. | 405/210 |

(Continued)

FOREIGN PATENT DOCUMENTS

| | | | |
|---|---|---|---|
| JP | H0710080 | A | 1/1995 |
| JP | 2008215481 | A | 9/2008 |

OTHER PUBLICATIONS

International Search Report and Written Opinion dated Sep. 4, 2014 in corresponding International application No. PCT/US2014/032994 (13 pages).

(Continued)

*Primary Examiner* — Frederick L Lagman
(74) *Attorney, Agent, or Firm* — Osha • Liang LLP

(57) ABSTRACT

According to one or more embodiments disclosed herein is a method of transporting equipment between sea-surface and seafloor by providing a structure with equipment mounted thereon. The equipment may be liquid storage tanks, pumps, compressors, separators, metering systems, energy sources, communication systems, buoyancy tanks, and the like. The structure is used for disposal and installation in a subsea environment by changing the volume of buoyancy material within at least one buoyancy tank.

20 Claims, 4 Drawing Sheets

(56) References Cited

U.S. PATENT DOCUMENTS

| | | | | |
|---|---|---|---|---|
| 3,837,310 | A * | 9/1974 | Toyama | 405/210 |
| 3,855,809 | A * | 12/1974 | Westling | 405/210 |
| 3,898,846 | A | 8/1975 | McCabe | |
| 4,007,700 | A * | 2/1977 | Haynes et al. | 405/210 |
| 4,059,065 | A | 11/1977 | Clark et al. | |
| 4,141,377 | A | 2/1979 | Fernandez et al. | |
| 4,190,072 | A | 2/1980 | Fernandez et al. | |
| 5,199,594 | A | 4/1993 | Obara et al. | |
| 5,778,679 | A | 7/1998 | Celorier, Jr. et al. | |
| 6,527,002 | B1 | 3/2003 | Szakaly | |
| 6,945,187 | B1 | 9/2005 | Woodall et al. | |
| 7,448,404 | B2 | 11/2008 | Samuelsen et al. | |
| 7,654,279 | B2 | 2/2010 | Horton, III et al. | |
| 7,841,289 | B1 * | 11/2010 | Schanz | 114/257 |
| 8,387,817 | B1 | 3/2013 | Zelechonok | |
| 8,678,711 | B2 | 3/2014 | Wu | |
| 2012/0305411 | A1 * | 12/2012 | Elazari-Volcani | 206/6 |

OTHER PUBLICATIONS

Non-Final Office Action issued Nov. 6, 2014 in related U.S. Appl. No. 13/858,024 (11 pages).

Notice of Allowance issued Apr. 30, 2015 in related U.S. Appl. No. 13/858,024 (5 pages).

* cited by examiner

LARGE SUBSEA PACKAGE DEPLOYMENT METHODS AND DEVICES

CROSS-REFERENCE TO RELATED APPLICATION

This application, pursuant to 35 U.S.C. §120, claims benefit to U.S. patent application Ser. No. 13/858,024, filed Apr. 6, 2013. That application is herein incorporated by reference in its entirety.

BACKGROUND

Many subsea petroleum production activities require the use of chemicals or mud to be added to the active operation to properly operate. Historically, these chemical provisions have been provided through hoses, tubes or pipes bundled into "umbilicals" to supply the chemicals from nearby surface facilities to the respective points of injection. Longer offsets, remote locations and deeper water depths contribute to making umbilical solutions expensive.

Existing subsea chemical storage in use today may be used for short-term single purpose use and have relatively small volumes. For example, a number of bladder style chemical storage tanks have been developed for this purpose. Existing subsea chemical storage assemblies may include single wall flexible tanks or bladders that are exposed directly to sea, which may be contained within some cage or frame for protection and transportation. However, the sizes of these storage tanks are relatively small (hundreds of gallons). Additionally, the application use subsea is typically short term (days).

SUMMARY

In one aspect, embodiments of the present disclosure relate to a structure having at least one buoyancy tank and at least one liquid storage tank, wherein the liquid storage tank has a rigid outer container and at least two inner containers including a first inner container containing seawater and a second inner container containing at least one stored liquid, wherein the at least two inner containers are flexible, wherein the at least two inner containers are pressure balanced, and wherein the volume of the outer container remains fixed, and the volumes of the at least two inner containers are variable.

In another aspect, embodiments of the present disclosure relate to a method of transporting payloads between a sea surface and a seafloor that includes providing a structure having at least one buoyancy tank, and changing a volume of buoyancy material within the at least one buoyancy tank.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Large subsea packages may be constructed with a barge-like structure having a central area that contains several thousand barrels of chemical storage in flexible bladders or tanks, such as identified in U.S. patent application Ser. No. 13/858,024. The barge-like structure may support a payload of up to approximately 600 tons of chemicals that are lowered and positioned on the seafloor in a controlled manner. An arrangement of buoyancy tanks may be incorporated into the barge-like structure, such that when the buoyancy tank is empty (air filled), the entire structure and payload is able to float on the surface of the water similar to a barge. When this buoyancy tank is water filled, the volume of fixed buoyancy limits the apparent underwater weight that the hoisting equipment would support as the entire structure and payload transits to or from the water surface and the seafloor.

This ability to safely transit large payloads from the surface to the seafloor represents a unique and useful method for placing and recovering other large payloads on the seafloor. The payloads may be any combination of equipment or process equipment needed at the seafloor. The deployment may be temporary or semi-permanent depending upon the payload and its function on the seafloor.

Several unique aspects and devices are described in this application that allow the lowering and positioning of these large structures and their payloads onto the seafloor a viable and safer operation.

Figure 6:
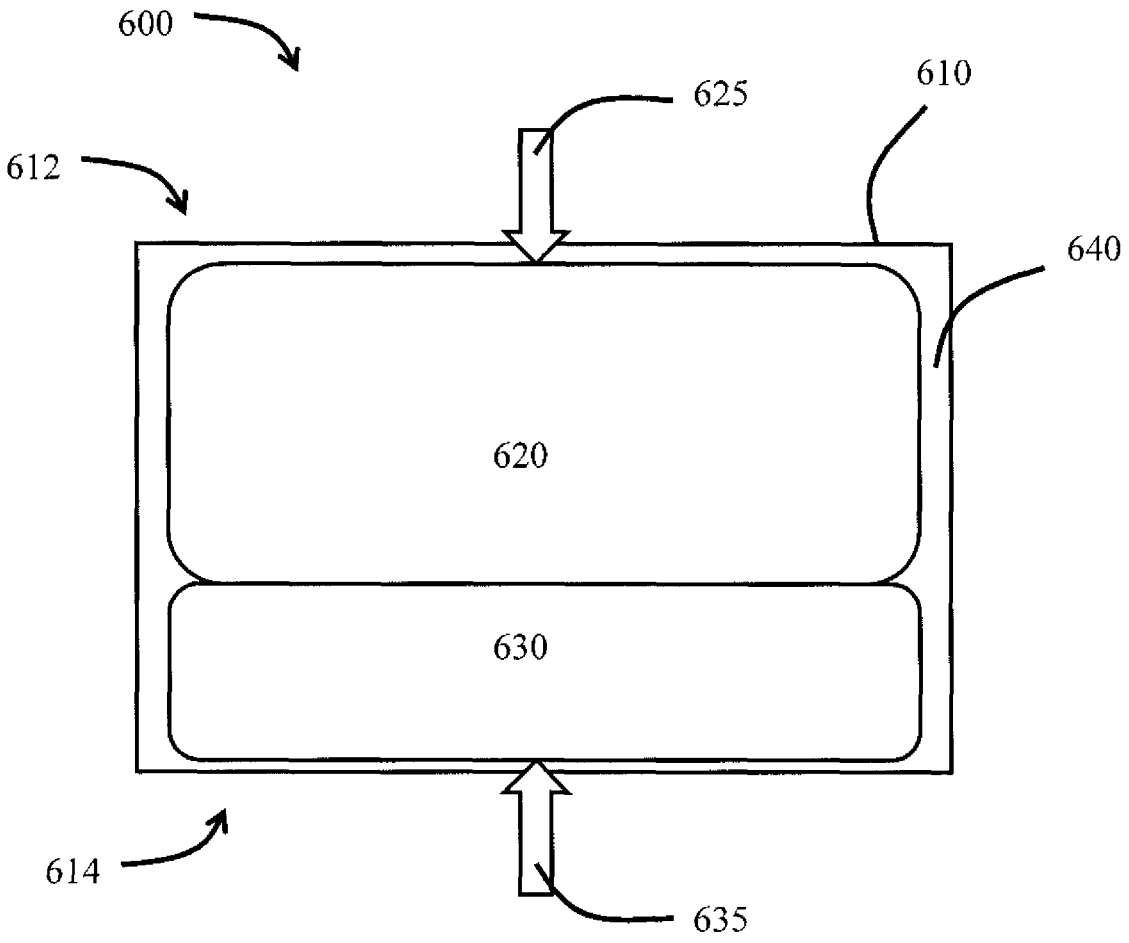
FIG. 6 shows a liquid storage tank according to embodiments of the present disclosure.

According to embodiments of the present disclosure, a structure may have at least one liquid storage tank and at least one buoyancy tank. FIG. 6 shows an example of a liquid storage tank according to embodiments of the present disclosure. The storage tank 600 has a rigid outer container 610 and at least two flexible inner containers 620, 630. The inner containers 620, 630 may be, for example, bladders made of a flexible, durable material suitable for storing liquids in a subsea environment, such as polyvinyl chloride ("PVC") coated fabrics, ethylene vinyl acetate ("EVA") coated fabrics, or other polymer composites. The inner containers include a first inner container 630 containing seawater and a second inner container 620 containing at least one stored liquid. The inner containers are pressure balanced such that as the stored liquid is added or removed from the second inner container 620, a corresponding volume of seawater may outflow or inflow from the first inner container 630. The inner containers 620, 630 may be equipped with closure valves that close and seal-off when the associated inner container fully collapses, which may protect the integrity of the inner containers by not subjecting the inner containers to potentially large differential pressures. Further, while the volumes of the at least two inner containers are variable, the volume of the outer container 610 remains fixed. The outer container 610 may act as an integral secondary or backup containment vessel that would contain any leak from the inner containers, thus creating a pressure balanced dual barrier containment system. As used herein, a "dual barrier" system refers to a system where both an inner container and an outer container have to fail before there is a tank content leak or discharge to the sea environment. Monitoring of the conditions in the space 640 between the dual barriers may provide an indication of required repairs for a failure of a primary barrier (an inner container).

Further, the volume of the outer container 610 remains fixed, and the volumes of the at least two inner containers 620, 630 are variable. For example, while the stored liquid may be added or removed from the second inner container 620 through a controlled opening 625 (and increase or decrease the respective volume of the second inner container 620) and a corresponding volume of seawater may outflow or inflow from the first inner container 630 through a controlled opening 635 (and decrease or increase the respective volume of the first inner container 630), the size and volume of the rigid outer container 610 remains fixed. A barrier fluid may be disposed between the annular space 640 between the outer container 610 and the inner containers 620, 630. The barrier fluid may be monitored for contamination, such as contamination from a leak in one of the inner containers. For example, the barrier fluid may be monitored by disposing sensors within the annular space 640 between the outer container 610 and the inner containers 620, 630, or barrier fluid samples may be periodically collected and analyzed on a periodic basis. According to embodiments of the present disclosure, a storage tank may include at least one sensor disposed in the space between the outer container and the at least two inner containers. Sensors may be used in the storage tank, for example, to monitor contamination of the barrier fluid, as discussed above, to monitor the volumes of the at least two inner containers, to monitor temperature and/or pressure conditions, or to monitor other conditions of the storage tank.

The active volume of fluid in each inner container may be monitored by measuring the inner container's relative location to either the topside 612 or bottom side 614 of the outer container 610. As used herein, "topside" may refer to the side of the referenced component that faces the seawater surface when the component is installed at the sea floor, and "bottom side" may refer to the side of the referenced component that faces the sea floor when the component is installed at the sea floor. In some embodiments, monitoring the active volume of each inner container may be achieved by monitoring the inflow and outflow of the respective inner containers, which may help assure integrity of the storage system as well as provide an indication of the chemical dosing performed from the storage system.

The structure having at least one storage tank and at least one buoyancy tank may be used for payload deployment and recovery, and may also be used as a seafloor foundation for processing and equipment. This foundation may enable the pre-deployment assembly, testing and commissioning of such payloads.

Figure 1:
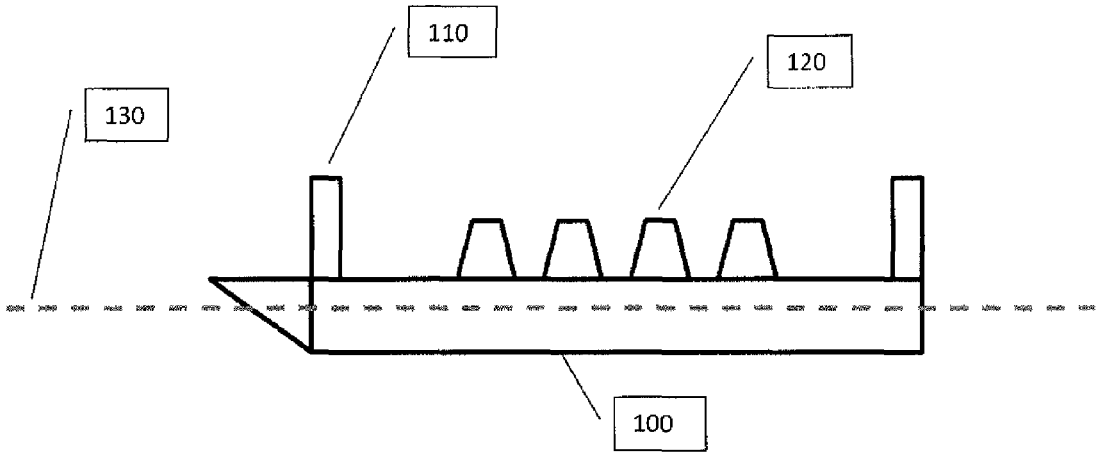
FIG. 1 shows a barge-like structure with semisubmersible columns and a payload of equipment mounted on the structure floating on the surface of the water.

Referring now to FIG. 1, a barge-like structure 100 according to embodiments of the present disclosure, is floating on the sea surface 130, and is equipped with a buoyancy tank 110. The structure 100 may act as a structural foundation for the support and operation of various seafloor equipment or other payload 120, such as tank 600. It is possible that the entire package of equipment may be tested and commissioned on the surface prior to its deployment to the seafloor. The unique deployment capability incorporates an integrated payload foundation to improve reliability of the equipment, minimize seafloor based construction and provide an effective and efficient recovery method should the equipment malfunction or need to be recovered for repairs, maintenance or modification.

An aspect of the buoyancy tank is to limit the maximum hoisting wire load as the entire structure and payload transit from the sea surface to and from the seafloor. This buoyancy tank may be either static or dynamic in nature. Static buoyancy refers to a permanently fixed in volume like an enclosed air tank or a solid volume of material like syntactic foam rated for the structure's working depth. Static buoyancy tanks may be attached or otherwise secured to the structure supporting the payload.

Figure 2:
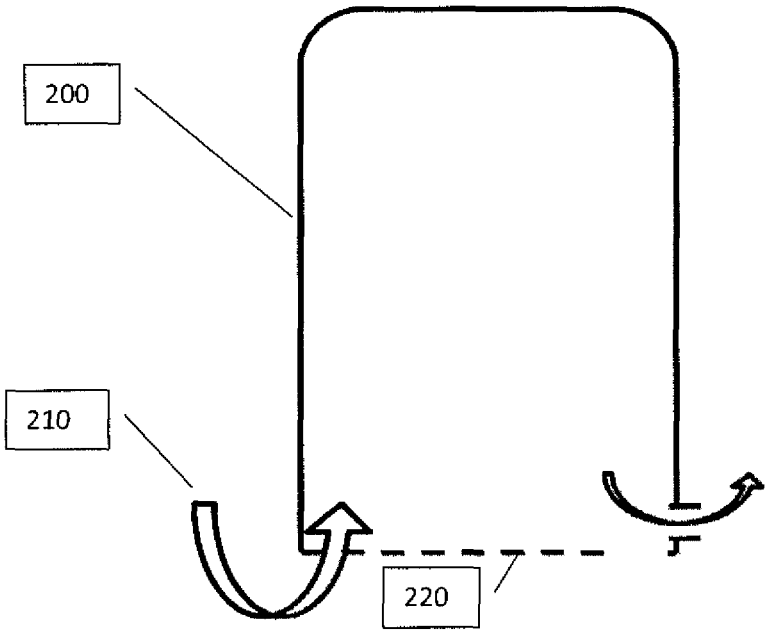
FIG. 2 shows an air or nitrogen filled dynamic buoyancy tank.

Dynamic buoyancy refers to buoyancy having some continuous activity to maintain its effective fixed buoyancy. An example of dynamic buoyancy is shown in FIG. 2, which includes an open bottom tank 200 that is air or nitrogen filled. As this tank 200 is moved to deeper water depths, the increasing hydrostatic pressure compresses the air within the open bottom tank 200. To maintain the desired fixed buoyancy value, additional compressed air has to be dynamically added to the tank to keep it air-filled. This may be accomplished with a high pressure air or nitrogen source 210. Any excess air added to the buoyancy tank may bubble out the open bottom of the tank. The lowering rate of the entire structure and the rate of compressed air addition to the dynamic buoyancy tank may be operationally coordinated to maintain the desired hoisting load within its operating range. This coordination maintains the water-air interface 220 at the tank vent level or at its open bottom.

After open bottom dynamic buoyancy tanks have sat on the seafloor for an extended period of time, much of the compressed air may diffuse into the seawater. Whenever the entire structure is to be recovered, one of the early recovery steps may include re-establishing the required air volume within these dynamic buoyancy tanks, which may include establishing a high pressure line (like coiled tubing) through which compressed air or nitrogen can be distributed to refill the buoyancy tanks to re-establish their lift. Once the structure is being hoisted up by a surface work ship hoist and the hydrostatic pressure drops, the tank's internal air volume may start expanding. Any of this excess air may bubble out the open bottom of the tank to automatically maintain the desired buoyancy.

Figure 3:
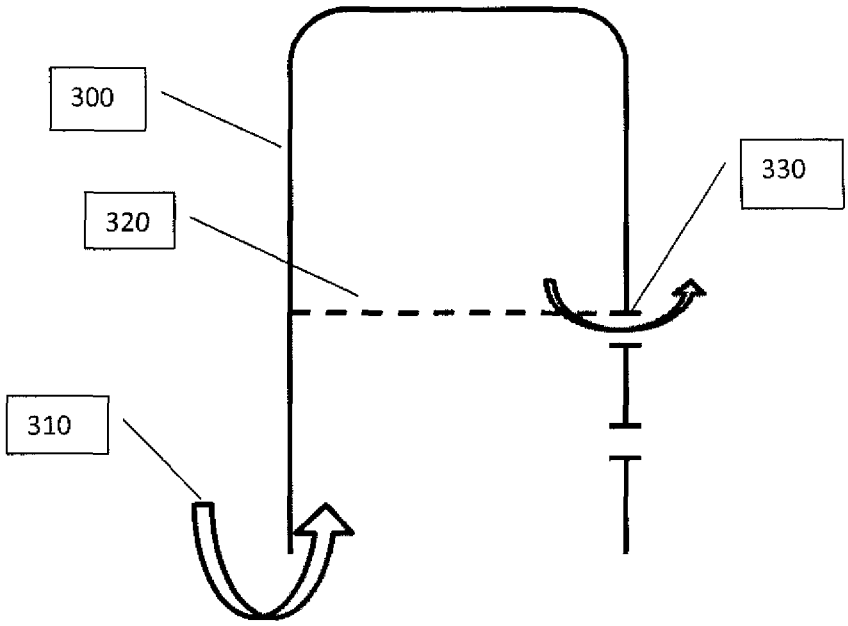
FIG. 3 illustrates the dynamic buoyancy tanks with vent holes for lift adjustment using air or nitrogen.

According to embodiments of the present disclosure, a feature of a dynamic buoyancy tank may include the ability to open or close vent holes vertically aligned in the side of the tank. For example, FIG. 3 shows a dynamic buoyancy tank 300 having vent holes 330 vertically aligned in the side of the tank 300. The vent holes may be opened or closed to adjust the effective buoyancy and the water-gas interface location 320. To maintain the desired buoyancy value, additional compressed air may be dynamically added to the tank to keep it air-filled. This may be accomplished with a high pressure air or nitrogen source 310. The dynamic buoyancy tank 300 may provide and allow for better hoist load adjustment, especially if the payload occasionally varies in weight between structure deployments.

One or more dynamic buoyancy tanks, such as the one shown in FIG. 3, may be attached to a larger assembly or structure. A dynamic buoyancy tank may be attached to a structure to assist in hoisting or lowering the structure under water. For example, when a structure having dynamic buoyancy tanks is being recovered, it may be hoisted to a near surface underwater depth (for example 500 ft.), at which point the hoisting may be stopped. The buoyancy tanks may be filled with air to the level of a vent hole formed in the dynamic buoyancy tank. The vent hole may then be closed underwater, for example, with an ROV. The surface support vessel may then begin moving underway and the hoisting operation slowly resumes. As the buoyancy tank rises the reduced hydrostatic pressure may cause the internal gas to expand forcing additional water from the tank resulting in increased lift. The total lift may increase to a point where the entire structure (tanks, payload, etc) becomes positively buoyant (load in lift line goes to zero) and the entire structure floats to the surface behind the surface support vessel. Drag caused from the surface support vessel being underway assures the structure floats up behind the surface support vessel and not under it. Once on the surface and floating behind the surface support vessel, additional water may be removed and the structure may be secured for floating at the surface and rigged for towing, such as illustrated in FIG. 1.

Figure 4:
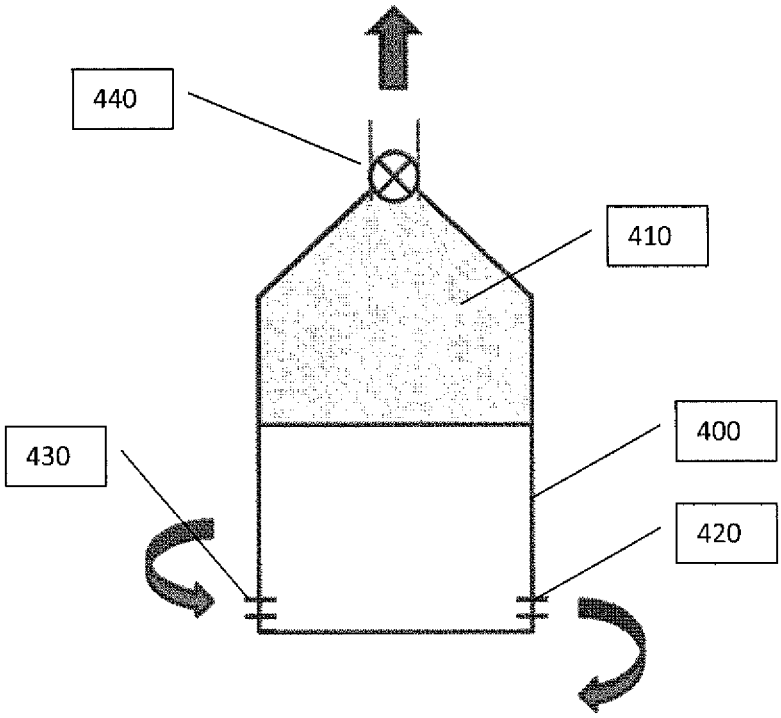
FIG. 4 illustrates a water filled buoyancy tank where the buoyancy material within the tank is loose spherical material.

Referring now to FIG. 4, a water filled static buoyancy tank 400 according to some embodiments of the present disclosure is shown. The static buoyancy tank 400 holds some volume of pressure depth rated buoyancy material 410. Such buoyancy materials may include microspheres or other buoyancy spheres up through a size that is capable of being pumped. All of the buoyancy material may be loose and float to the top of the water filled tank. A slurry of water and buoyancy material may be pumped into the bottom of the tank through an inlet port 430. The volume of the tank slows the velocity of the slurry sufficient that the buoyancy material separates and floats to the top of the tank where a dense buoyant pack is formed. The excess water is discharged through a water vent 420. The water exit vent 420 may be fitted with filters to minimize any potential loss of residual buoyancy material that does not fully separate. The lift of the tank 400 may be adjustable by managing the amount of buoyancy material placed within the tank.

The top of the tank 400 may be cone shaped and fitted with a closure valve 440. A pipe or hose may be connected to the closure valve using an educator type pump to remove the buoyancy material from the structural tank. To minimize the risk of buoyancy material bridging, the ratio of water and buoyancy material solids may be managed. High pressure buoyancy material used in the tank may provide constant lift to the structure in which the buoyancy tank is contained as the structure is lowered to the seafloor (unlike the dynamic buoyancy previously described.) If the structure is to be routinely recovered, then leaving the buoyancy in-place may simplify both the structure's initial installation as well as its recovery operations. However, if the structure and its payload will remain on the seafloor for a long period, the buoyancy recovery capability may minimize buoyancy cost.

Figure 5:
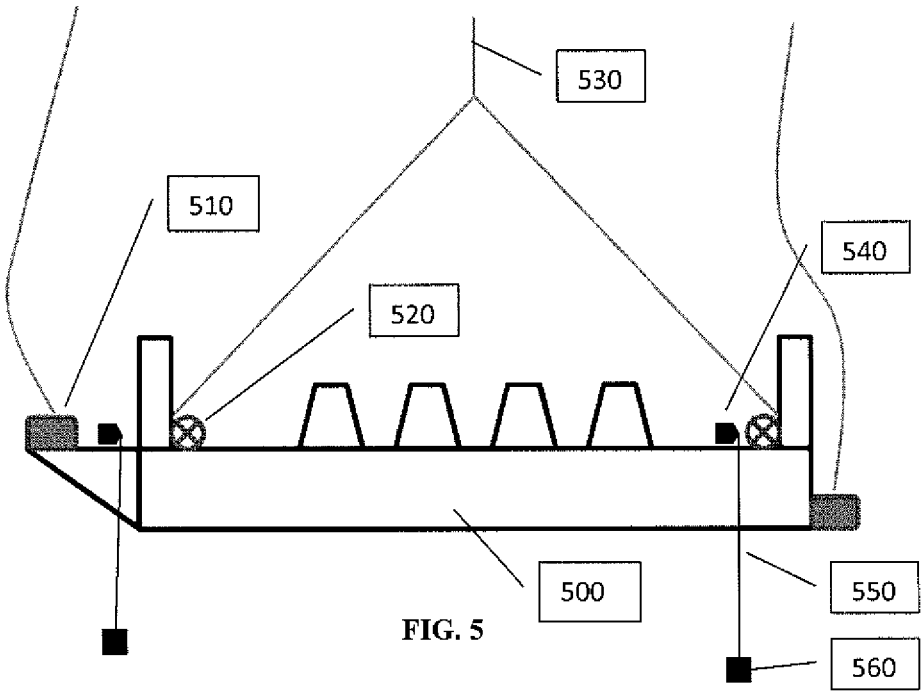
FIG. 5 shows a diagram of a structure according to embodiments of the present disclosure.

FIG. 5 shows a structure 500 according to embodiments of the present disclosure. Whether providing transit and a foundation for equipment or setting a large volume of chemistry or storage on the seafloor the structure 500 may be maneuvered into a desired location and orientation on the seafloor. The structure may be maneuvered by coordinating the surface position of the hoisting vessel with its hoisting equipment and lift line 530 for vertical positioning, in coordination with the fine horizontal positioning capabilities of one or more Remote Operated Vehicles 510 (ROVs) maneuvering the structure during its last stages of being lowered onto its seafloor foundation.

The ability of the ROVs 510 to finely maneuver and position a structure at the seafloor may be a direct function of the thruster power which may be about 40 hp per current work class ROV. Thus, when the structure's maneuvering thrust requirements exceed the ROVs thrust capabilities, the ability to accurately position the large structure may deteriorate. To overcome this lack of required thrust, supplementary remotely operated thruster packages 520 may be added to the structure. Since these supplementary thrusters are only required for the short period of time during the final seafloor structure positioning, they may be temporarily attached to the structure.

According to embodiments of the present disclosure, a thruster package may be deployed and recovered by an ROV from a structure. The thruster package may be physically connected to the structure in order to transfer the thrust load to the structure. Power for operation of the thruster package may come through a separate umbilical, such as through the ROV or from an integrated power package like batteries. Remote control of the thruster package may be via wire, fiber, wireless, free water optics or other such subsea communication link(s).

An alternative for seafloor positioning may include sitting the structure 500 upon pre-positioned supports, such as piles or suction anchors, for example, if the seafloor is soft. Such supports may have guidance mechanisms for final positioning as the structure 500 is lowered into position. To provide control during final landing on the supports, ROV operated subsea winches 540 on the structure may lower wires 550 down below the structure 500 when it nears the seafloor. The ROV may then connect these "pull-down" wires 550 to the support guidance using attachments 560. Once the wires 550 are attached to the foundation, the winches 540 are operated to start pulling down the structure into its final seafloor position. This pull-down may be accomplished by pulling against the vessel's hoist system motion compensator causing proportional payout of the hoisting wire 530. The unique aspect of this operational alternative is the combination of a pull-down subsea winch causing corresponding payout of a motion compensated hoist to control the safe landing of structures on seafloor supports.

According to embodiments of present disclosure, a method of transporting payloads between a sea surface and a seafloor may include using a structure having at least one buoyancy tank, such as described above, and changing a volume of buoyancy material within the at least one buoyancy tank to support the payload. For example, the structure may be lowered to the seafloor, wherein compressing the volume of buoyancy material within the at least one buoyancy tank includes adding at least a portion of the buoyancy material to the at least one buoyancy tank. In another example, the structure may be lifted from the seafloor, wherein expansion of the volume of buoyancy material within the at least one buoyancy tank includes releasing buoyancy material from the at least one buoyancy tank. The buoyancy material may be, for example, at least one of air, nitrogen and spheres of buoyant material ranging in size from fine powder to large spheres. In some embodiments, changing the volume of buoyancy material may include filling the at least one buoyancy tank with loose buoyancy materials through the use of water-buoyancy material slurry. For example, the water-buoyancy material slurry may be added to or removed from the at least one buoyancy tank with a slurry lift pump.

In some embodiments, a structure used to transport payloads between a sea surface and seafloor may have at least one liquid storage container and at least one buoyancy tank with an open bottom buoyancy tank, wherein the open bottom buoyancy tank has at least one vent hole along a side of the open bottom buoyancy tank. The volume of buoyancy material within the at least one buoyancy tank may be changed by closing the at least one vent hole at a near surface depth.

Further, in some embodiments, a method of transporting a payload may include pulling a structure having at least one liquid storage container and at least one buoyancy tank with a surface support vessel.

According to some embodiments, a method of transporting a payload may include using at least one subsea thruster package attached to a structure having at least one buoyancy tank to transport a payload. For example, the subsea thruster package may be controlled with a remote operated vehicle or may be remotely controlled to help manipulate the structure. A subsea thruster package may be powered through an umbilical or by using at least one battery. Further, at least one subsea pull-down winch in association with a motion compensated hoisting line may be used to control the positioning and lowering of a structure having at least one buoyancy tank onto at least one seafloor support.

Further, the barge-like structure may be fitted with piping and compartments to house and protect the chemical injection pump and meter components that route the chemicals (or other liquid other than seawater) through high pressure hoses or tubes to their injection points. In some embodiments, the injection pump and related components located on the barge-like structure with the storage tank may be de-ballasted, returned to the sea-surface, and transported to shore, and thus may be routinely maintained along with the storage tank. In some embodiments, the injection pump and metering components may be separately located on a barge-like structure that is independently maintained.

Depending upon the chemical dosing rate and the application, both the piping and injection pump may be appropriately sized, or if the chemical (or other liquid) injection is into a sub-hydrostatic environment, then a throttling valve and metering system may also be used. A control pod may control injection pumps and to monitor any sensors monitoring the operation of the storage tank and the metering system. The control pod may interface into the production control system using standard protocols. Further, a flying lead for power, data, and command communications may be deployed from the storage tank to the subsea electrical connection point. The control pod, pump and metering system may be located onboard the storage tank or it may be separately positioned in the production system. Lockers for flying leads (both electrical and chemical) may be located on the storage tank, which may manage the flying leads during tank deployment and recovery. A locker may be optimized for ROV operation. A flying lead deployment mechanism may also facilitate the efficient recovery of flying leads in the event the barge-like structure is changed out. Further, other equipment such as compressors, energy sources, separators, and other such equipment which may be useful separately or in various combinations may be used in conjunction with embodiments of the present disclosure.

Although only a few example embodiments have been described in detail above, those skilled in the art will readily appreciate that many modifications are possible in the example embodiments without materially departing from embodiments disclosed herein. Accordingly, all such modifications are intended to be included within the scope of this disclosure as defined in the following claims.

What is claimed:

1. A structure, comprising:

at least one liquid storage tank, wherein the liquid storage tank comprises:

an outer container, wherein the outer container is rigid;

at least two inner containers comprising:

a first inner container containing seawater; and a second inner container containing at least one stored liquid;

wherein the at least two inner containers are flexible;

wherein the at least two inner containers are pressure balanced; and wherein the volume of the outer container remains fixed, and the volumes of the at least two inner containers are variable;

at least one open bottom buoyancy tank.

2. The structure of claim 1, wherein the open bottom buoyancy tank comprises at least one vent hole along a side of the open bottom buoyancy tank.

3. A method of transporting at least one liquid storage tank between a sea surface and a seafloor, by:

providing a structure comprising:

an outer container, wherein the outer container is rigid;

at least two inner containers comprising:

a first inner container containing seawater; and a second inner container containing at least one stored liquid;

wherein the at least two inner containers are flexible;

wherein the at least two inner containers are pressure balanced; and wherein the volume of the outer container remains fixed, and the volumes of the at least two inner containers are variable;

at least one open bottom buoyancy tank;

changing a volume of buoyancy material within the at least one open bottom buoyancy tank.

4. The method of claim 3, wherein the open bottom buoyancy tank comprises at least one vent hole along a side of the open bottom buoyancy tank.

5. The method of claim 4, wherein changing the volume of buoyancy material within the at least one open bottom buoyancy tank comprises closing the at least one vent hole at a near surface depth.

6. The method of claim 3, further comprising lowering the structure to the seafloor, wherein changing the volume of buoyancy material within the at least one open bottom buoyancy tank comprises adding at least a portion of the buoyancy material to the at least one open bottom buoyancy tank.

7. The method of claim 3, further comprising lifting the structure from the seafloor, wherein changing the volume of buoyancy material within the at least one open bottom buoyancy tank comprises releasing buoyancy material from the at least one open bottom buoyancy tank.

8. The method of claim 7, wherein the buoyancy material comprises at least one of air, nitrogen or spheres of buoyant material.

9. The method of claim 3, further comprising pulling the structure with a surface support vessel.

10. The method of claim 3, wherein changing the volume of buoyancy material comprises filling the at least one open bottom buoyancy tank with loose buoyancy materials through the use of water-buoyancy material slurry.

11. The method of claim 10, wherein the water-buoyancy material slurry is added to the at least one open bottom buoyancy tank with a slurry lift pump.

12. The method of claim 3, wherein the at least one open bottom buoyancy tank comprises an exit port closure.

13. The method of claim 3, further comprising at least one subsea thruster package attached to the structure.

14. The method of claim 13, further comprising controlling the at least one subsea thruster package with a remote operated vehicle.

15. The method of claim 13, further comprising remotely controlling the at least one subsea thruster package.

16. The method of claim 13, wherein the at least one subsea thruster package is powered through an umbilical.

17. The method of claim 16, wherein the at least one subsea thruster package is powered using at least one battery.

18. The method of claim 3, further comprising using at least one subsea pull-down winch with a motion compensated hoisting line to control the positioning and lowering of the structure onto at least one seafloor support.

19. A method of transporting equipment between sea-surface and seafloor, by:

providing a structure comprising:

an outer container, wherein the outer container is rigid;

at least two inner containers comprising:

a first inner container containing seawater; and a second inner container containing at least one stored liquid;

wherein the at least two inner containers are flexible;

wherein the at least two inner containers are pressure balanced; and wherein the volume of the outer container remains fixed, and the volumes of the at least two inner containers are variable;

at least one open bottom buoyancy tank;

changing a volume of buoyancy material within the at least one open bottom buoyancy tank; and wherein said equipment is mounted on the structure and is selected from a group consisting of liquid storage tanks, pumps, compressors, separators, metering systems, energy sources, and communication systems.

20. The method of claim 19, wherein the structure provides a stable sea-floor foundation for the support and operation of the equipment mounted thereon.

* * * * *